US006243048B1

(12) United States Patent
Luh

(10) Patent No.: US 6,243,048 B1
(45) Date of Patent: Jun. 5, 2001

(54) GREGORIAN REFLECTOR ANTENNA SYSTEM HAVING A SUBREFLECTOR OPTIMIZED FOR AN ELLIPTICAL ANTENNA APERTURE

(75) Inventor: Howard Ho-shou Luh, Sunnyvale, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/499,052

(22) Filed: Feb. 4, 2000

(51) Int. Cl.[7] ..... H01Q 19/19
(52) U.S. Cl. ..... 343/781 P; 343/781 CA
(58) Field of Search ..... 343/781 P, 781 CA, 343/837; H04Q 19/12, 19/18, 19/19

(56) References Cited

U.S. PATENT DOCUMENTS 5,684,494 * 11/1997 Nathrath et al. ..... 343/781 P

* cited by examiner

*Primary Examiner*—Michael C. Wimer
(74) *Attorney, Agent, or Firm*—Kenneth W. Float

(57) ABSTRACT

A Gregorian reflector antenna system optimized for an elliptical antenna aperture. The Gregorian reflector antenna system comprises a main reflector, a subreflector, and a feed horn for illuminating the subreflector. The subreflector illuminates the main reflector with an elliptically shaped feed cone of energy. The subreflector has a surface defined by the equation $$\frac{x^2}{a^2} + \frac{y^2}{b^2} + \frac{z^2}{c^2} = 1,$$

where x, y, and z are three axes of the Cartesian coordinate system. The terms a, b, and c are three parameters that define the surface of the subreflector

2 Claims, 3 Drawing Sheets

GREGORIAN REFLECTOR ANTENNA SYSTEM HAVING A SUBREFLECTOR OPTIMIZED FOR AN ELLIPTICAL ANTENNA APERTURE

BACKGROUND

The present invention relates generally to Gregorian reflector antenna systems, and more particularly, to a Gregorian reflector antenna system having a subreflector optimized for an elliptical antenna aperture.

The assignee of the present invention deploys communication satellites containing communications systems. Gregorian reflector antenna systems are typically used on such communication satellites. Previously deployed Gregorian reflector antenna systems have not used a subreflector having a surface that is optimized when the aperture produced by the main reflector is an ellipse.

Accordingly, it is an objective of the present invention to provide for a Gregorian reflector antenna system having a subreflector optimized for an elliptical antenna aperture.

SUMMARY OF THE INVENTION

To accomplish the above and other objectives. the present invention provides for an improved Gregorian reflector antenna system. The Gregorian reflector antenna system comprises a main reflector, a subreflector, and a feed horn for illuminating the subreflector.

The subreflector illuminates the main reflector with an elliptically shaped feed cone of energy. The subreflector has a surface defined by the equation $$\frac{x^2}{a^2}+\frac{y^2}{b^2}+\frac{z^2}{c^2}=1,$$

where x, y, and z are three axes of the Cartesian coordinate system as shown in FIG. 5. The terms a, b, and c are three parameters of the surface of the subreflector.

The present Gregorian reflector antenna system has improved performance compared with conventional Gregorian reflector antenna systems that are not optimized for the shape of the antenna aperture. The Gregorian reflector antenna system is intended for use on an LS20.20 satellite developed by the assignee of the present invention.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 2:
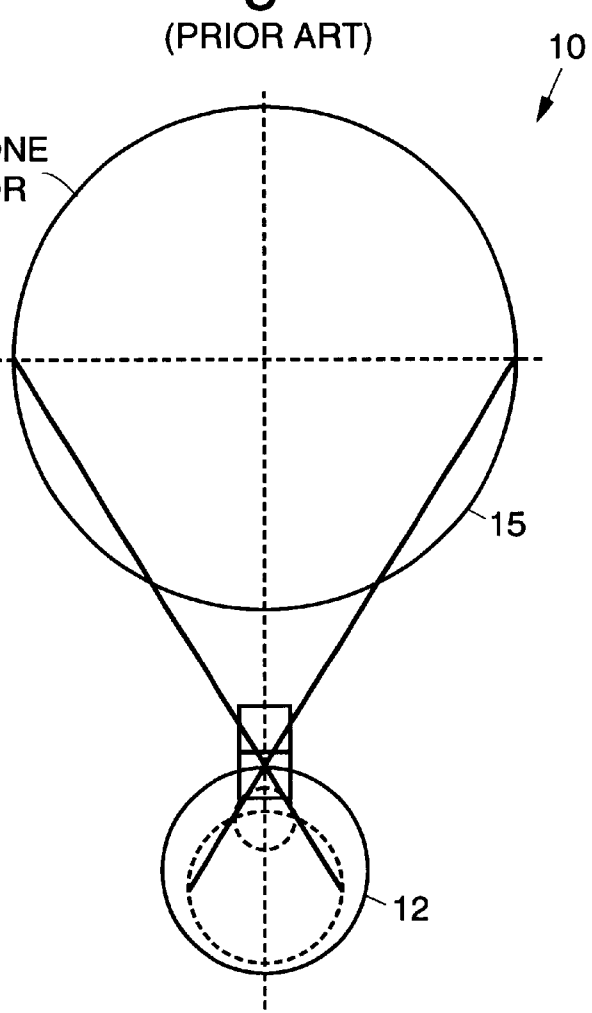
Fig. 2 (PRIOR ART)
FIGS. 1 and 2 illustrate side and front views of a conventional Gregorian reflector antenna system.
Figure 1:
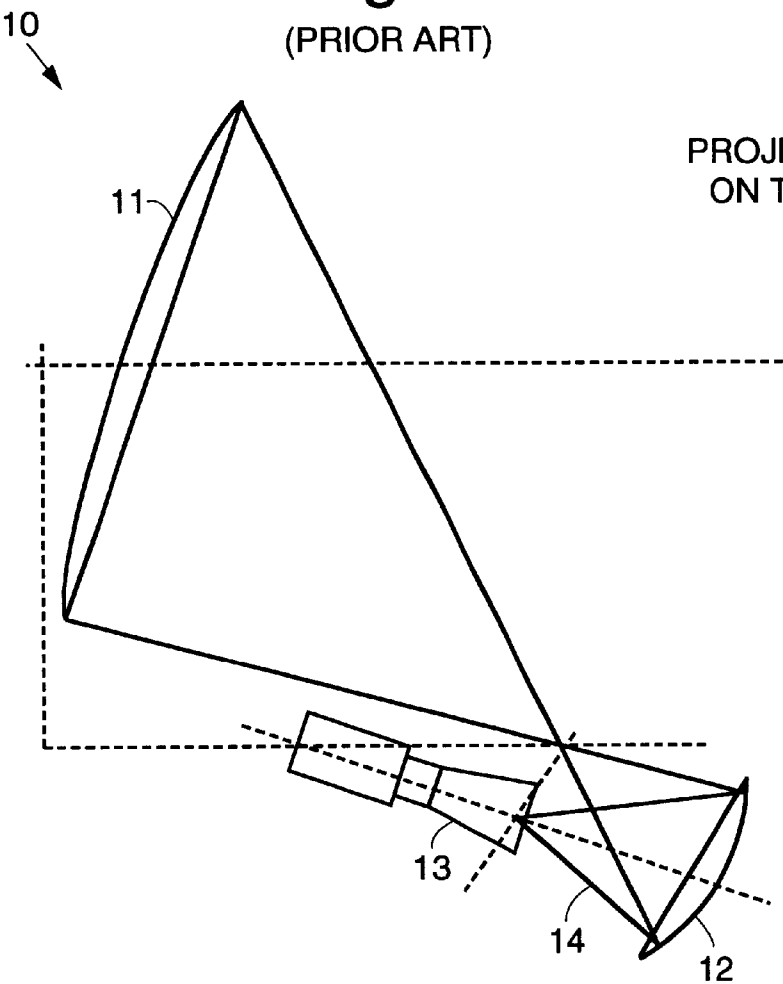
Fig. 1 (PRIOR ART)

Referring to the drawing figures, FIGS. 1 and 2 illustrate side and front views of a conventional Gregorian reflector antenna system 10. The conventional Gregorian reflector antenna system 10 comprises a main reflector 11, a subreflector 12, and a feed horn 13. The feed horn 13 illuminates the subreflector 12 with energy in the shape of a feed cone 14 which is in turn reflected to the main reflector 11. The main reflector 11 reflects the feed cone 14 to produce a beam on the earth.

FIG. 2 illustrates the projection 15 of the feed cone 14 on the surface of the main reflector 11. In the conventional Gregorian reflector antenna system 10, the projection 15 of the feed cone 14 on the surface of the main reflector 11 has a circular shape.

The surface of the subreflector 12 of the conventional Gregorian antenna system 10 may be defined by the equation $$\frac{x^2}{a^2}+\frac{y^2}{b^2}+\frac{z^2}{b^2}=1, \tag{1}$$

The surface of the conventional subreflector is defined by two parameters, a and b, as given in Equation (1).

The surface of the conventional subreflector 12 defined by equation (1) projects the feed cone 14 into a circle on the main reflector 11 as is shown in FIG. 2. When the aperture of the main reflector 11 is a circle, the conventional subreflector 12 is the proper subreflector 12 to be used.

Figure 4:
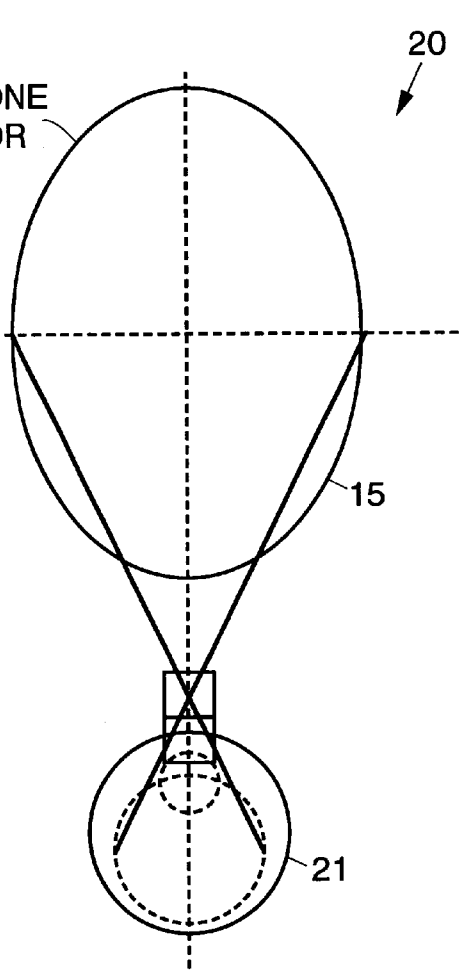
FIGS. 3 and 4 illustrates side and front views of a Gregorian reflector antenna system in accordance with the principles of the present invention.
Figure 3:
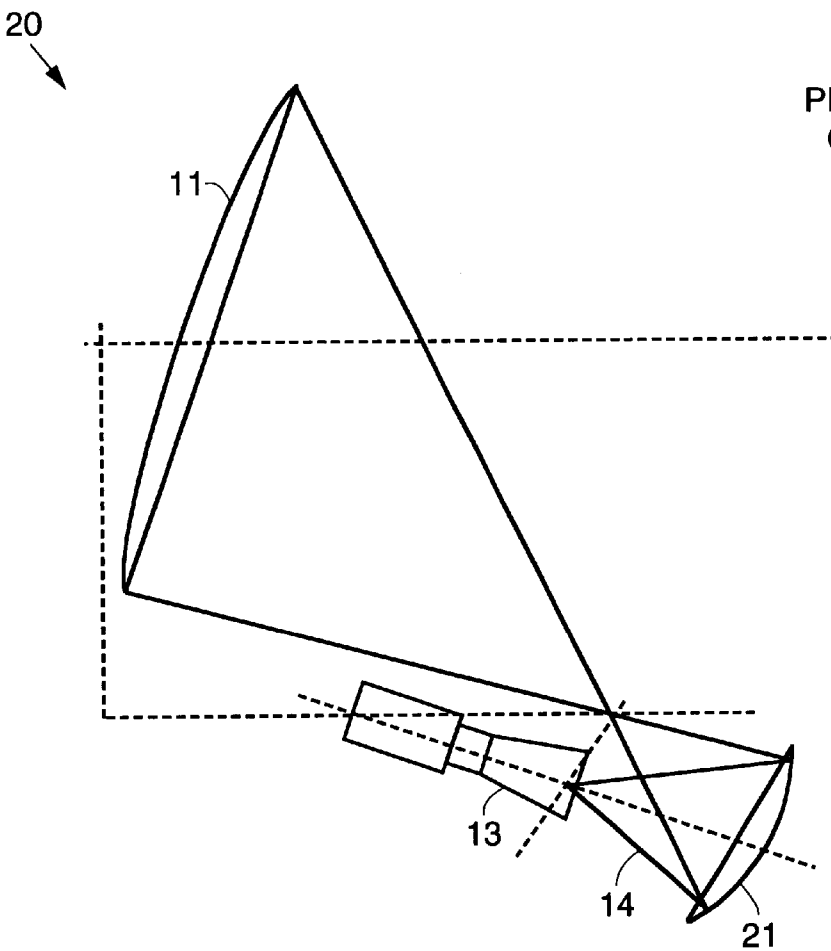

Referring to FIGS. 3 and 4, they illustrate side and front views of a Gregorian reflector antenna system 20 in accordance with the principles of the present invention. The Gregorian reflector antenna system 20 comprises a main reflector 11, a subreflector 21 having a specially configured surface, and a feed horn 13. The Gregorian reflector antenna system 20 operates in the same manner as the conventional Gregorian reflector antenna system 10.

The surface of the subreflector 21 used in the Gregorian reflector antenna system 20 of the present invention is defined by the equation $$\frac{x^2}{a^2}+\frac{y^2}{b^2}+\frac{z^2}{c^2}=1, \tag{2}$$

where a, b and c are parameters that are determined to define the surface of the subreflector 21. Of course, when c=b, equation (2) reduces to equation (1).

When the aperture of the main reflector 11 is an ellipse, as is shown in FIG. 4, such as is produced by the main reflector 11 on an LS20.20 satellite developed by the assignee of the present invention, the projection mismatch (circle versus ellipse) represents an inefficient utilization of the main reflector 11. The present subreflector 21 described by equation (2) projects the feed cone 14 into an ellipse on the main reflector 11 as is shown in FIG. 4. Thus the performance of the antenna system 20 is improved in comparison to the conventional Gregorian reflector antenna system 10.

Figure 5:
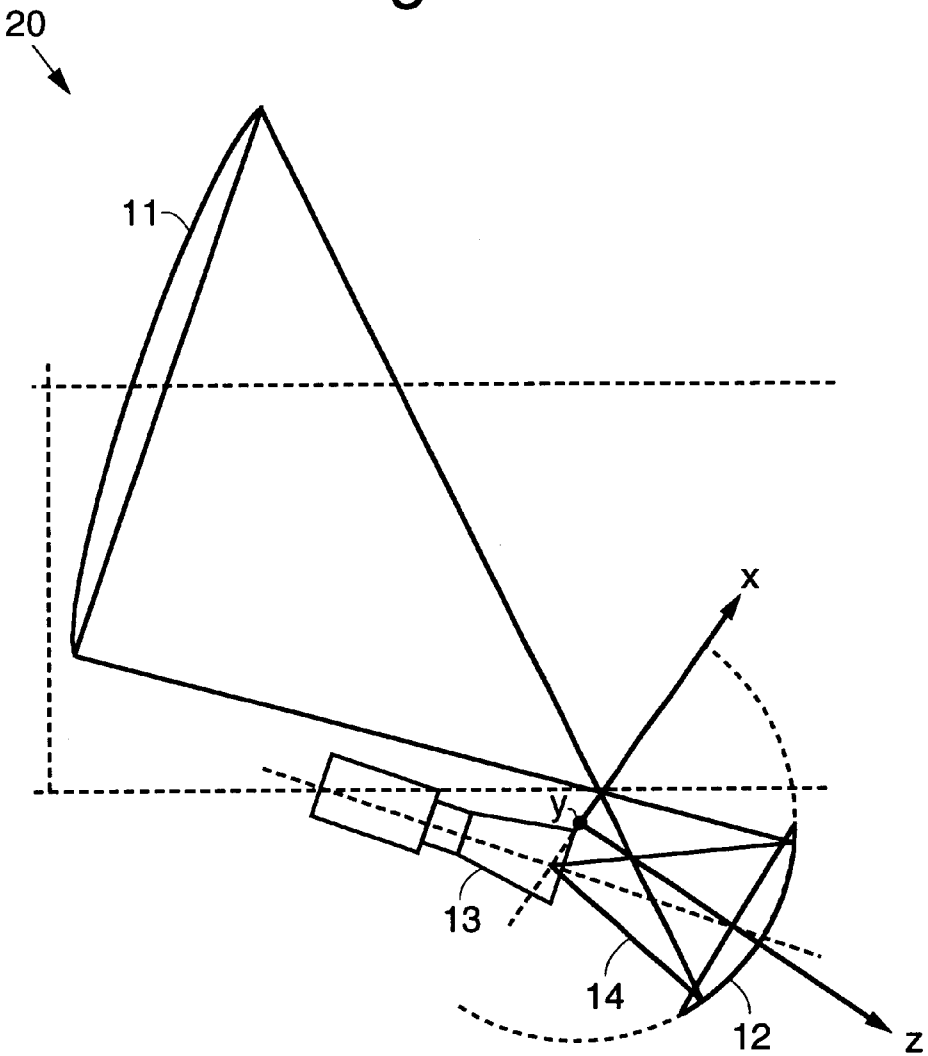
FIG. 5 illustrates additional details of the present Gregorian reflector antenna system.

Referring to FIG. 5, it illustrates additional details of the Gregorian reflector antenna system 20 of the present invention. In the Gregorian reflector antenna system 20 shown in FIG. 5 the surface of the subreflector 21 is a sector of a surface expressed by the equation $$\frac{x^2}{a^2}+\frac{y^2}{b^2}+\frac{z^2}{c^2}=1,$$

where a, b and c are parameters that determine the surface shape. By way of example, for the Gregorian reflector antenna system 20 designed for use on the LS20.20 satellite, the subreflector 21 has the following parameters: a=25.0603 inches, b=26.252 inches, and c=24.905 inches.

Thus, a Gregorian reflector antenna system having a subreflector optimized for an elliptical antenna aperture has been disclosed. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A Gregorian reflector antenna system comprising:

an elliptically shaped main reflector;

a subreflector for illuminating the elliptically shaped main reflector with an elliptically shaped feed cone of energy, which subreflector has a surface defined by the equation $$\frac{x^2}{a^2} + \frac{y^2}{b^2} + \frac{z^2}{c^2} = 1,$$

where x, y, and z are three axes of the Cartesian coordinate system, and a, b, and c are three parameters that define the surface of the subreflector; and a feed horn for illuminating the subreflector.

2. The Gregorian reflector antenna system recited in claim 1 wherein the elliptically shaped main reflector comprises an elliptically shaped antenna aperture.

* * * * *